US006068154A

United States Patent [19]

Grabher

[11] Patent Number: 6,068,154

[45] Date of Patent: May 30, 2000

[54] CAN HAVING A CLOSURE MEMBRANE AND AN INVERTED LID

[76] Inventor: Werner Grabher, Oberwingerstrasse 8, CH9436 Balgach, Switzerland

[21] Appl. No.: 09/076,734

[22] Filed: May 13, 1998

[30] Foreign Application Priority Data

May 14, 1997 [CH] Switzerland ..... 1129/97

[51] Int. Cl.[7] ..... B65D 51/18

[52] U.S. Cl. ..... 220/256; 220/258; 220/782

[58] Field of Search ..... 220/256, 257, 220/258, 780, 781, 782, 794, 619, 623, 624, 309.1, 240; 215/271; 229/5.5

[56] References Cited

U.S. PATENT DOCUMENTS

| | | | |
|---|---|---|---|
| 1,086,007 | 2/1914 | Wollitzer . | |
| 1,750,204 | 3/1930 | Wichner . | |
| 1,790,068 | 1/1931 | Murphy . | |
| 1,808,975 | 6/1931 | Wright . | |
| 1,867,288 | 7/1932 | Thomas . | |
| 2,006,952 | 7/1935 | Klein . | |
| 2,037,675 | 4/1936 | Boothby et al. . | |
| 2,049,264 | 7/1936 | Karl | 220/258 |
| 2,150,308 | 3/1939 | Annen . | |
| 2,226,178 | 12/1940 | Page . | |
| 2,244,940 | 6/1941 | Carruth . | |
| 2,331,346 | 10/1943 | Reese | 220/258 |
| 2,336,852 | 12/1943 | Elmendorf . | |
| 2,505,748 | 5/1950 | Barbieri . | |
| 2,551,090 | 5/1951 | Bergstein . | |
| 2,671,593 | 3/1954 | Page . | |
| 2,858,037 | 10/1958 | Rose . | |
| 3,135,418 | 6/1964 | Tracy | 220/258 X |
| 3,157,336 | 11/1964 | Elam . | |
| 3,204,849 | 9/1965 | Vinney . | |
| 3,215,325 | 11/1965 | Shappell et al. . | |
| 3,288,341 | 11/1966 | Krause . | |
| 3,344,974 | 10/1967 | Bostrom . | |
| 3,400,853 | 9/1968 | Jocobsen | 220/624 |
| 3,402,874 | 9/1968 | Sternau . | |
| 3,498,521 | 3/1970 | Gill . | |
| 3,712,530 | 1/1973 | Croley . | |
| 3,814,279 | 6/1974 | Rayzal | 220/624 |
| 3,935,615 | 2/1976 | Wakeman . | |
| 3,937,392 | 2/1976 | Swisher . | |

(List continued on next page.)

FOREIGN PATENT DOCUMENTS

| | | |
|---|---|---|
| 0007487 | 2/1980 | European Pat. Off. . |
| 0241026 | 10/1987 | European Pat. Off. . |
| 0540748 | 5/1993 | European Pat. Off. . |
| 0611703 | 8/1994 | European Pat. Off. . |
| 1593395 | 7/1970 | France . |
| 2219066 | 9/1974 | France . |
| 881899 | 7/1953 | Germany . |
| 8108034 | 8/1984 | Germany . |
| 4234857 | 4/1994 | Germany . |
| 9414440 | 1/1995 | Germany . |
| 60-24238 | 2/1985 | Japan . |
| 642316 | 4/1984 | Switzerland . |
| 659633 | 2/1987 | Switzerland . |
| 8404507 | 11/1984 | WIPO . |

*Primary Examiner*—Nathan J. Newhouse
*Attorney, Agent, or Firm*—Rothwell, Figg, Ernst & Kurz, p.c.

[57] ABSTRACT

The can is closed on at least one end face with a membrane (2) of paper or plastic or metal foil in such a way that the outside of the foil edge region raised toward the can axis (3) is tightly connected to the essentially cylindrical inside can wall (1). An inverted lid (9) is mounted over the membrane (5), at the end face of the can. The membrane surface (5) comprises at least one contact region **(7*a*, 7*b*) which projects toward the end face and, when the inverted lid (9) is mounted, can be placed at least partly on a support region (12*a*, 12*b*) of the inside of the lid surface (10). Consequently, the outward-directed forces acting on the closure membrane (5) are absorbed by the lid (9) and the danger of leaking membranes (5)** is essentially eliminated. The cans according to the invention can be filled at high speed and with materials of high density, can be transported without precautions and can be exposed to large vacuums.

6 Claims, 1 Drawing Sheet

U.S. PATENT DOCUMENTS

| | | | |
|---|---|---|---|
| 3,955,006 | 5/1976 | Sokolsky et al. | 220/256 X |
| 4,042,164 | 8/1977 | Croley . | |
| 4,044,941 | 8/1977 | Knudsen . | |
| 4,094,457 | 6/1978 | Spillson . | |
| 4,098,404 | 7/1978 | Markert | 220/624 X |
| 4,109,822 | 8/1978 | Egli . | |
| 4,109,848 | 8/1978 | Kipp et al. . | |
| 4,153,196 | 5/1979 | Dutcher . | |
| 4,154,360 | 5/1979 | Smith | 220/258 |
| 4,174,784 | 11/1979 | Hartung | 215/271 X |
| 4,289,265 | 9/1981 | Ellerbrock . | |
| 4,299,350 | 11/1981 | Woerz . | |
| 4,331,255 | 5/1982 | Fournier . | |
| 4,341,337 | 7/1982 | Beach, Jr. et al. . | |
| 4,557,414 | 12/1985 | Ford et al. . | |
| 4,564,139 | 1/1986 | Reil . | |
| 4,599,123 | 7/1986 | Christensson . | |
| 4,706,874 | 11/1987 | Reil . | |
| 4,736,885 | 4/1988 | Negus, Sr. . | |
| 4,799,590 | 1/1989 | Furman . | |
| 4,850,506 | 7/1989 | Heaps, Jr. et al. . | |
| 4,998,638 | 3/1991 | Kawamata | 220/256 X |
| 5,100,009 | 3/1992 | Thompson et al. | 220/619 X |
| 5,152,418 | 10/1992 | Kroeschell et al. . | |
| 5,385,255 | 1/1995 | Varano et al. . | |
| 5,669,550 | 9/1997 | Klemme et al. . | |

CAN HAVING A CLOSURE MEMBRANE AND AN INVERTED LID

BACKGROUND OF THE INVENTION

1. Field of the Invention

The invention relates to a can according to the preamble of claim 1.

Cans having a cylindrical can body running around the can axis, a can base and a closure arrangement arranged at the end opposite the can base are used for holding various products. The tightly closable closure arrangement comprises a closure membrane and an outside lid. The closure membrane closes the can cylinder tightly in an end region and optionally consists of paper and/or plastic (in particular laminated with thin aluminum foil), but preferably of a metal foil, in particular of aluminum, all of which is also referred to below merely as membrane or toil for the sake of simplicity. Optionally, the membrane or foil can be removed in a manner known per se with the aid of tear-off tabs. Outside lids are placed on the can for protecting the fragile foil and for closing the can after removal of the foil, the edge of the outside lid extending over the can edge, at least on the outside but optionally also on the outside and inside.

The collar-like edge of the closure membrane is raised toward the can axis, the terminating surface of the foil being in the interior of the can and the collar-like edge extending from the terminating surface toward the or to the can edge at the end face. The membrane collar is generally cylindrical and is firmly connected, or glued or sealed, to a corresponding cylindrical end region of the inside of the can cylinder. The—preferably flanged—can edge may be overlapped by the membrane collar or may be free. If the collar does not extend over the can edge, this facilitates the mounting and tearing off of the foil.

2. Description of the Background Art

WO 96/31406 discloses cans, in particular tin cans, having a membrane foil and having an inverted lid. The membrane foils described therein are at most 0.2 mm thick and consist, for example, of a 50 $\mu$m aluminum foil with 20 $\mu$m heat-seal coating on the inside and 10–20 $\mu$m lacquer on the outside. Depending on the contents and on any lid used, the can base can if required also be formed with a foil and in particular with an overlapping base.

In general, it is preferable if the membrane foil is coated, at least in the region intended for connection to the inner surface of the can—with a heat-seal coating. In principle, however, the inner surface of the can can also be provided in the region mentioned—like that of combination cans (e.g. laminated with aluminum foil)—with a primer or a heat-sealable coat; otherwise, the tight connection frequently requires the use of special—in particular multicomponent—adhesives or heat-seal coatings. In any case, bare or coated tin cans can also be tightly closed therewith.

CH 467 202 describes a can having a closure membrane which consists of flat material which has the same thickness as the can cylinder and from which only a central part surrounded by a break-out line can be removed.

The problem of the at least partly removable closure membrane is that it must be removable with application of a relatively small force. Consequently, impacts of the contents against the closure membrane can cause the closure membrane to break open or at least to leak in the connection region or in the region of the break-out line. Impacts of the contents against the membrane occur, for example, during transport. If the can lid is directed downwards, the gravitational force of the can contents acts on the membrane in addition to the impacts. Most cans are filled through the still open can base, with inserted membrane and mounted outside lid. The contents entering strike the membrane, the force acting on the membrane depending directly on the density and the feed rate of the contents. With fast filling and/or heavy contents, leaks occur if the cans are overfilled. In the case of cans having easily removable membranes the low pressure which occurs during air transport or during transport in mountainous regions may also lead to detachment of the membrane. Even if the action of force leads only to irreversible deformation, this may be undesirable in particular applications.

Although the inserted lids known per se overcome these problems, they are more material-consumptive owing to the required grip ring and are therefore more expensive than outside lids, so that there is a desire for the latter.

SUMMARY OF THE INVENTION

It is the object of the invention to provide a closure arrangement having easily removable closure elements, i.e. in particular having a closure membrane and an outside lid, so that the cans remain tight even under the possible forces acting on the membrane, such as, for example, during fast filling, in particular with heavy contents, and during transport.

To achieve the object, the characterizing features of claim 1 are provided together with the features of the preamble. The danger of leaking membranes is essentially eliminated by virtue of the fact that the outward-directed forces acting on the closure membrane can be transmitted to the lid at least in regions or contact regions through the possibility of placing said region or regions on support regions of the inside of the lid. The cans according to the invention can therefore be filled at higher speed and with materials of high density, can be transported without precautions and can also be exposed to relatively large vacuums.

To prevent large forces from acting in the closure membrane and/or from this on the outside lid, for example when the can is in a low-pressure environment, the membrane comprises an expansion region, preferably between two contact regions. The expansion region is roll-like or bead-like and runs along a closed line, preferably a circle but optionally also an ellipse, around the can axis. The expansion region permits a deformation of the closure membrane in association with a volume change in the closed can region, in particular an enlargement or reduction of the undulation in the expansion region. Optionally, a springy movement of the membrane regions inside and outside the expansion region relative to one another is also achievable.

The type of pressure-related deformation of the closure membrane depends not only on the shape and the material of the membrane but also on the support region or regions of the outside lid. The inverted lid may be formed from plastic or cardboard. Preferred embodiments ensure an elastic or reversible deformation even for large volume changes, so that the can does not appear inflated even after it was exposed to a low pressure. It may be expedient if the cavity between the membrane and the lid is connected to the environment via a small equilibration orifice so that movements of the membrane are not transmitted to the lid. To give the lid a firm seat in a defined position, the collar of the lid is provided with, for example, a groove which, in the desired position, holds a ring, in particular the outward-projecting flange. Of course, any desired tightly fitting connections between lid and cylindrical can body may be provided.

Further details of the invention are evident from the following description of an embodiment shown.

DETAILED DESCRIPTION OF THE PREFERRED EMBODIMENTS

Figure 1:
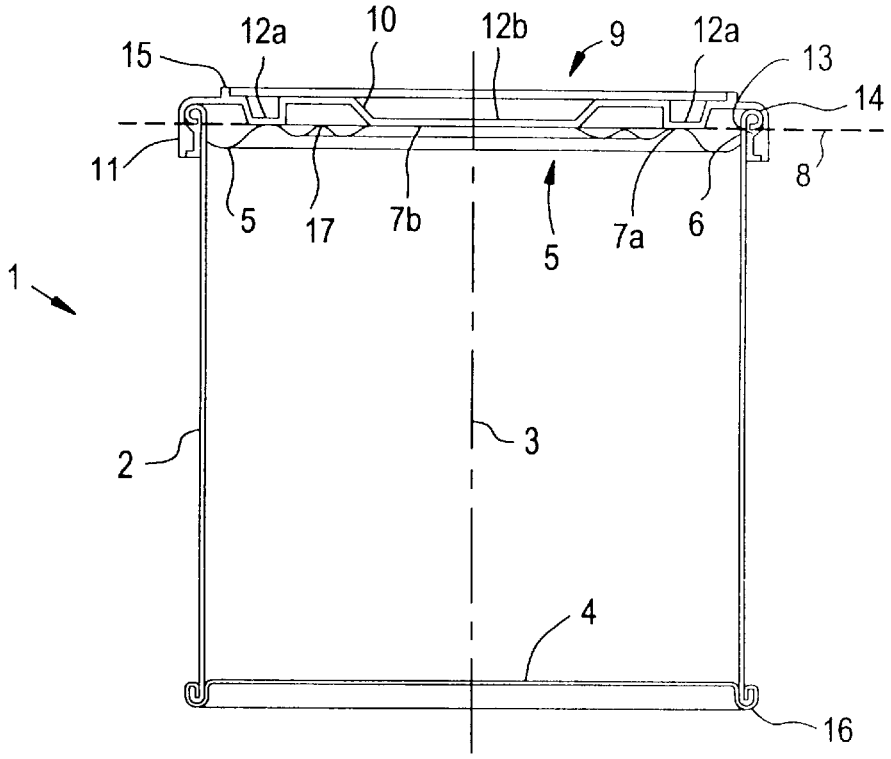
FIG. 1 shows a section, parallel to the axis, through a can having a closure membrane and outside lid

According to FIG. 1, a can 1 comprises a cylinder 2 which is arranged around the can axis 3. The can 1 is closed with a base 4 at one end face of the cylinder 2. The base 4 is tightly connected to the cylinder 2 in any desired known manner. A closure membrane 5 in the interior of the can is arranged in the end region of the can 2, which region is opposite the base 4. The periphery of the closure membrane 5 is formed as a collar 6 whose cylindrical region is tightly connected, in particular heat-sealed, to the inner surface of the cylinder 2. The closure membrane 5 comprises at least one contact region 7*a*, 7*b*, 17 which projects toward the end face and, when the outside lid 9 is mounted, can be placed on a corresponding support region 12*a*, 12*b* of the inside of the lid.

In the embodiment shown, a first contact region 7*a* is formed in a roll-like manner along a closed line, preferably a circle but also an ellipse, around the can axis 3. A second contact region 7*b* is formed as a central region of the closure membrane 5. Both contact regions 7*a*, 7*b* project toward an annular terminating surface 12*a* of the cylindrical can body 2, as far as a contact plane 8.

An outside lid 9 is removably mounted on that end face of the can cylinder 2 which is closed by means of the membrane 5. The lid 9 comprises a lid surface 10, which closes the can orifice, and a lid collar 11 which surrounds the can cylinder 2 on the outside of the end region. The inside of the lid surface 10 is provided with at least one support region 12*b* in which the inside of the lid surface runs in the region of the contact plane 8 and is thus adjacent to at least one contact region 7*a*, 7*b* of the membrane surface 5. In the embodiment shown, a first and a second support region 12*a* and 12*b* projecting inward toward the interior of the can are formed. The first or second support region 12*a* or 12*b* is coordinated with the first or second contact region 7*a* or 7*b* and, in accordance with this, extends around the can axis 3. The first support region 12*a* thus runs in a roll-like manner in the interior of the can, along a closed line, preferably a circle but optionally also an ellipse. The second support region 12*b* is formed as a central region of the lid surface, slightly drawn into the interior of the can.

To hold the lid firmly in the desired position on the can, a groove 13 is formed in the inward-facing surface of the lid collar 11 and serves for receiving the annular projection 14 formed by the flange of the cylinder end. When the lid is mounted, the lid surface 10, in the regions not formed as support regions 12*a*, 12*b*, lies essentially in the terminating plane at the end of the can cylinder 2. A ring 15 projecting upward from the lid surface 10 fits into a recess in the can base 4 so that the cans 2 are stackable. The recess in the base 4 is located in the interior of the annular flange connection 16 between can base 4 and can cylinder 2.

Optionally, the membrane comprises an expansion region 17, preferably between two contact regions 7*a*, 7*b*. The expansion regions 7*b* and 17 are roll-like or bead-like and run along a closed line, preferably a circle but optionally an ellipse, around the can axis 3. The expansion region 17 permits a deformation of the closure membrane 5 in association with a volume change in the closed can region, in particular an enlargement or reduction of the roll in the expansion region 17.

Figure 2:
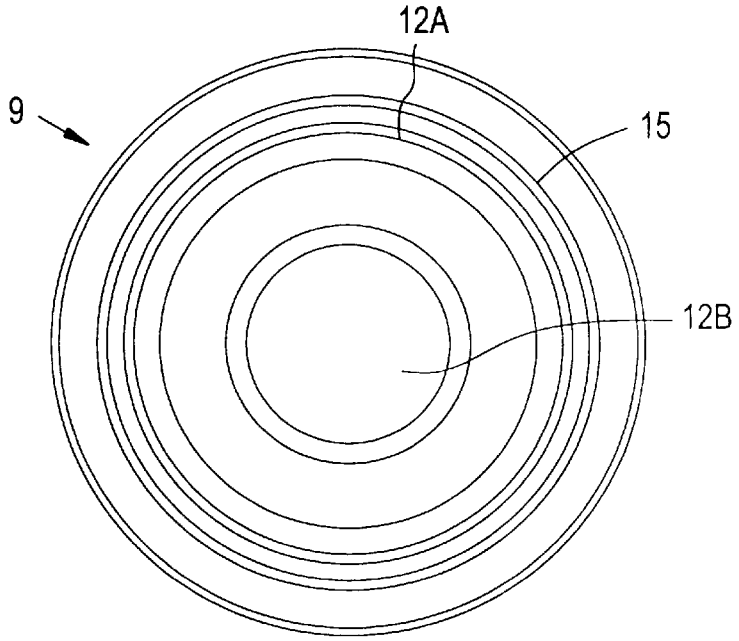
FIG. 2 shows a plan view of the can according to FIG. 1.

FIG. 2 shows that the lid and its regions are circular. Of course, any other desired lid cross-sectional shapes and arrangements of the regions are possible.

The invention is not limited to the embodiment shown. Of course, a very wide variety of arrangements of contact regions and/or support regions coordinated with one another are possible. Instead of closed lines and/or surfaces, radial lines or any desired combined lines, in particular interrupted or sectional arrangements, having the same function may be provided. It is also possible for the contact regions and support regions, for example, to run transverse to one another instead of being of identical shape, it preferably being ensured that the support and/or the deformation behavior is essentially the same in all rotational positions between membrane 5 and lid 9. Optionally, the contact plane 8 is essentially at the end of the can cylinder 2 so that the support regions need not project inward. Rather, the inside of the lid surface 10 may be flat and the support regions are those regions of the lid surface 10 which face the contact regions 7*a*, 7*b*.

What is claimed is:

1. A can comprising:

a cylindrical can body arranged around an axis and having two open end faces at least one of which is closed by:

a closure membrane having a periphery which extends in a direction of the can's axis, said closure membrane being sealed with an outer face of the periphery to an inside of the cylindrical can body in an area of said at least one pen end face, and a closure lid having a periphery which extends in the direction of the can's axis and is closed over said at least one open end face; wherein a part of said closure membrane overspanning said at least one open end face comprises at least one first region projecting away from said inside of the can body and toward said at least one open end face will respect to a remainder of said closure membrane, and a part of said closure lid overspanning said at least one open end face comprises at least one second region projecting toward said inside of the can body with respect to a remainder of said closure lid and wherein said second region is in contact with said first region so as to comprise at least one contact region.

2. The can according to claim 1 wherein said first and second regions are arranged in a center of said closure membrane and a center of said closure lid respectively.

3. The can according to claim 1 wherein said first and second regions are arranged around a center of said closure membrane and a center of said closure lid respectively.

4. The can according to claim 1 wherein said at least one contact region is in a form of a ring concentric around said axis.

5. The can according to claim 1 wherein said closure lid includes a third region projecting toward said at least one open end face, and said closure membrane includes a fourth region having an undulating cross-section and mating with said third region so as to permit a deformation of said closure membrane in a direction away from the inside of the can body in association with a volume change in the can.

6. The can according to claim 1 wherein said at least one open end face has a flange which is outwardly oriented with respect to said axis, and said closure lid has, on an inside of its periphery, an annular groove to receive said flange.

* * * * *